United States Patent [19]

Franz

[11] Patent Number: 5,002,294

[45] Date of Patent: Mar. 26, 1991

[54] SPRINGBOARD DEVICE AND CONVERSION ATTACHMENT FOR SKATEBOARD

[76] Inventor: David H. Franz, 7320 Wethersfield Dr., Orlando, Fla. 32819

[21] Appl. No.: 430,522

[22] Filed: Nov. 1, 1989

[51] Int. Cl.[5] ..... A63C 17/02

[52] U.S. Cl. ..... 280/87.042; 272/114; 280/1.182; 280/7.15

[58] Field of Search ..... 272/141, 142, 114, 96, 272/70.3; 280/1.182, 87.042, 7.15

[56] References Cited

U.S. PATENT DOCUMENTS

| | | | |
|---|---|---|---|
| 2,960,345 | 11/1960 | Chontos | 280/1.182 |
| 4,196,903 | 4/1980 | Illustrato | 272/114 |
| 4,449,256 | 5/1984 | Prueitt | 272/114 X |
| 4,645,223 | 2/1987 | Grossman | 280/87.042 X |
| 4,660,299 | 4/1987 | Omilusik | 272/114 X |
| 4,707,934 | 11/1987 | Hart | 272/114 X |
| 4,828,251 | 5/1989 | Schreiber | 272/114 |

*Primary Examiner*—Charles A. Marmor
*Assistant Examiner*—Michael Mar
*Attorney, Agent, or Firm*—Warren L. Franz

[57] ABSTRACT

Front and rear springboard assemblies having telescoping members biased apart by springs are provided for atachment at front and rear positions to a skateboard-like deck to provide a springboard device which can be moved foward along a path by successive leaps and bounds. In one embodiment, the assemblies are configured as attachments to be mounted on a conventional skateboard in place of wheeled trucks. In another embodiment, the assemblies are configured to serve as spring-loaded mounts onto which wheeled trucks are attached.

14 Claims, 3 Drawing Sheets

SPRINGBOARD DEVICE AND CONVERSION ATTACHMENT FOR SKATEBOARD

This invention relates to a springboard device and to a method for converting a conventional skateboard into such a device.

BACKGROUND OF THE INVENTION

Skateboarding has become a popular sport and pastime for persons of all ages, and especially for boys and girls of teen and preteen age. Skateboarding combines the appeal of surfboarding with that of conventional rollerskating, and offers the advantage to participants that it can be engaged in both at specially designed tracks and along sidewalks and other existing hard surfaces. Little or no special equipment is required other than the board itself; though, for safety's sake, a helmet and protective pads for knees and elbows are recommended.

Typical conventional skateboards comprise surfboard-like planar elliptical decks having upper surfaces for supporting a user and undersurfaces to which front and rear wheeled trucks attach with cushioned and pivotal connections to give weight-shift control for steering and acrobatic maneuvers. Such boards are frequently also provided with protective guard strips and rails at their front and side edges, and with braking stop bumpers at their tails. While not considered a group sport as such, skateboarding is a fun activity which can be shared at social gatherings and which promotes interaction among peers.

Before the rise in popularity of skateboarding, teens and preteens often played with a springboard toy, known as a "pogo stick." The pogo stick comprises a telescoping tubular stilt with pedals and a spring, used to move along a path in a series of leaps and bounds, with the user engaging in up and down hopping motions to reciprocate one part of the stilt axially relative to another against the bias of the spring.

SUMMARY OF THE INVENTION

It is an object of the present invention to provide a springboard device which offers attributes and features of a skateboard as well as those of a pogo stick.

It is a further object of the invention to provide an attachment for converting a conventional skateboard into such a springboard device.

In one aspect of the invention a springboard device is provided having front and rear springboard assemblies respectively attached at front and rear positions to the undersurface of a skateboard-style deck. Each springboard assembly includes first and second hollow members mounted coaxially, slidably one within the other, for relative telescopic movement against means biasing the members into spaced-apart relationship. In another aspect of the invention, the springboard assemblies are dimensioned, configured and adapted for respective attachment to front and rear mounting blocks of a conventional skateboard deck after removal of and in place of the traditional front and rear wheeled trucks of the skateboard.

In a preferred embodiment, discussed in greater detail below, the springboard assemblies each include a pair of hollow tubular sleeves respectively supported in opposing vertically-oriented positions within support ring collars on left and right sides of an assembly plate and into which open-topped tubular cups are telescopingly received. Biasing means in the form of coil springs are located within the cups to bias the cups into distal or downmost positions relative to the sleeves. Spline means, in the form of pins that connect to each cup through longitudinal channels in each sleeve, serve to retain the cups within the sleeves while permitting relative axial motion between the two. The assembly plates are advantageously dimensioned, configured and adapted for being respectively releasably attached to the undersurface of the deck of a conventional skateboard after removal of an in place of the traditional skateboard wheeled trucks utilizing the same attaching means.

BRIEF DESCRIPTION OF THE DRAWINGS

Embodiments of the invention have been chosen for purposes of illustration and description and are shown in the accompanying drawings, wherein.

Throughout the drawings, like elements are referred to by like numerals.

DETAILED DESCRIPTION OF PREFERRED EMBODIMENTS

The principles of the invention are illustrated with reference to exemplary implementations of embodiments thereof shown in FIGS. 3–6, usable with a known configuration of a conventional skateboard depicted in FIGS. 1 and 2.

Figure 1:
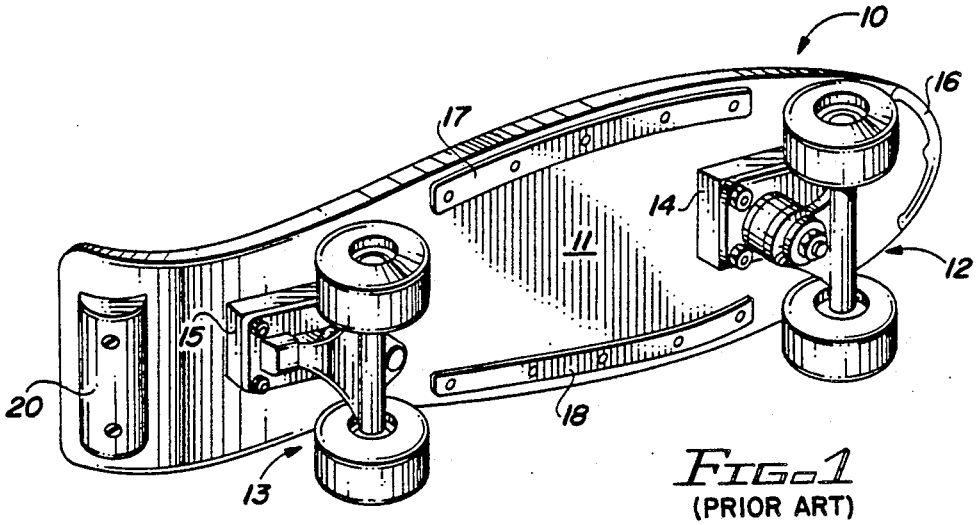
FIG. 1 (PRIOR ART)
FIG. 1 (prior art) is a perspective view, looking at the undersurface of a conventional skateboard.

As shown in FIG. 1, a conventional skateboard 10 has a generally horizontal, small surfboard-like, planar elliptical deck 11 and front and rear wheeled trucks 12 and 13 respectively releasably attached to depend vertically from mounting blocks 14, 15 located at front and rear positions on the undersurface of the deck 11. As shown in FIG. 1, the nose at the front edge of the deck 11 is covered by a protective guard strip 16, and left and right marginal edge portions of the undersurface of the deck 11 are provided respectively with left and right rail strips 17, 18. A tail stop bumper 20 is attached at the rear of the deck undersurface to assist in braking and to protect the rear of the board during nose raising acrobatic maneuvers.

Figure 2:
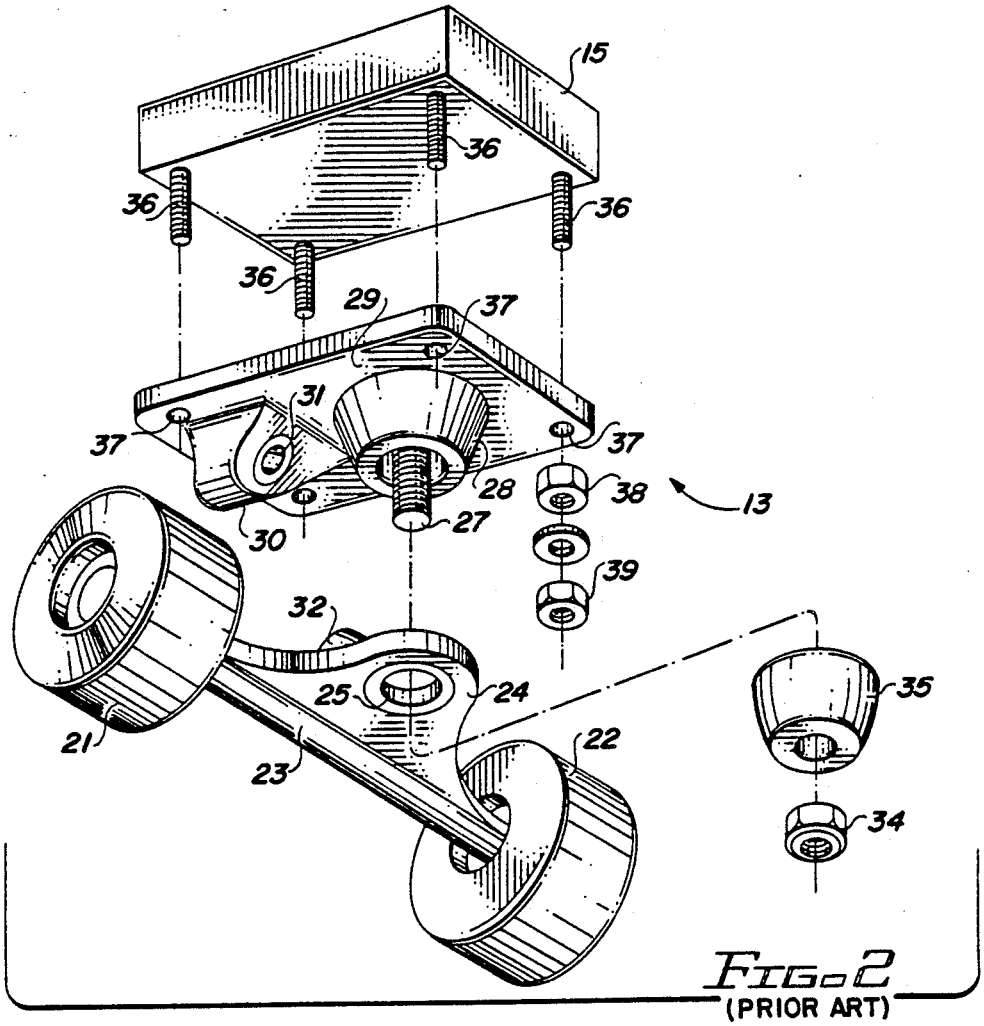
FIG. 2 (PRIOR ART)
FIG. 2 (prior art) is an enlarged, exploded view of the components of one of the traditional wheeled trucks of the skateboard of FIG. 1.

The components of the rear truck 13 which attaches to the undersurface of the deck 11 at the rear mounting block 15 are shown in FIG. 2. The components of the front truck 12 which attaches to the front block 14 are similar. The truck 13 comprises wheels 21, 22 respectively mounted at opposite extremes of a laterally extending axle 23 which has an upwardly extending, central lobe 24 with bore 25 that fits over a king pin or action bolt 27 which projects downwardly at a rearwardly facing angle from a stanchion portion 28 of an otherwise planar, rectangular riser pad 29. The pad 29 also includes, in traditional manner, a rearwardly swept protuberance 30 having a forwardly looking, angled bore 31 which serves as a pivot into which a rearwardly and upwardly facing pin 32 of the axle 23 is inserted. The wheels 21, 22 are mounted in customary manner for free rotation about the axis of the axle 23. The axle is secured to the action bolt 27 by means of a nut 34 which threads onto the bolt 27, with one or more cushion members 35 received between the stanchion 28 and nut 34 acting as shock absorbers and serving to bias the nut outwardly in locked engagement position against the threads of the bolt 27 in order to prevent its loosening during use of the board 10.

The upper surface of the riser pad 29 has a generally rectangular configuration which matches the corresponding rectangular configuration of the undersurface of the block 15, so that the pad 29 can be conveniently received in superposed aligned abutment with the block 15, as indicated in FIG. 2. Threaded posts 36 project vertically downward at each corner of the block 15 through respective aligned vertical bores 37 at each corner of the pad 29. Double nuts 38, 39 which threadingly interengage with the posts 36 at each corner serve to releasably lock the pad 29 against the block 15.

Figure 3:
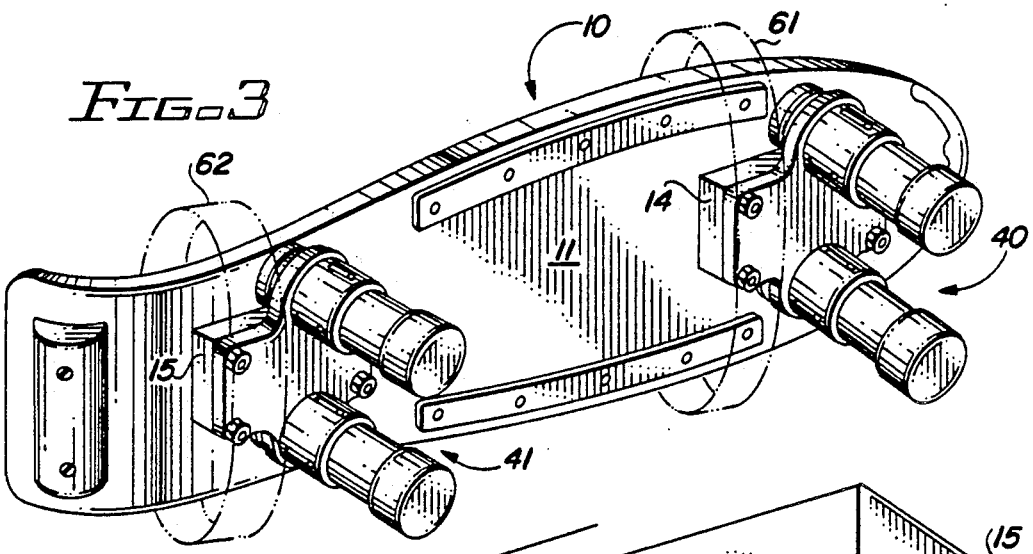
FIG. 3 is a view of the converted skateboard of FIG. 1 shown with the traditional wheeled trucks removed and replaced by springboard assemblies in accordance with the principles of the present invention.

In accordance with one aspect of the present invention, front and rear springboard assemblies 40, 41 are provided, as shown in FIG. 3, dimensioned, configured and adapted for being respectively releasably attached to the mounting blocks 14, 15 of the skateboard 10 of FIG. 1 in place of the traditional wheeled trucks 12, 13.

Figure 4:
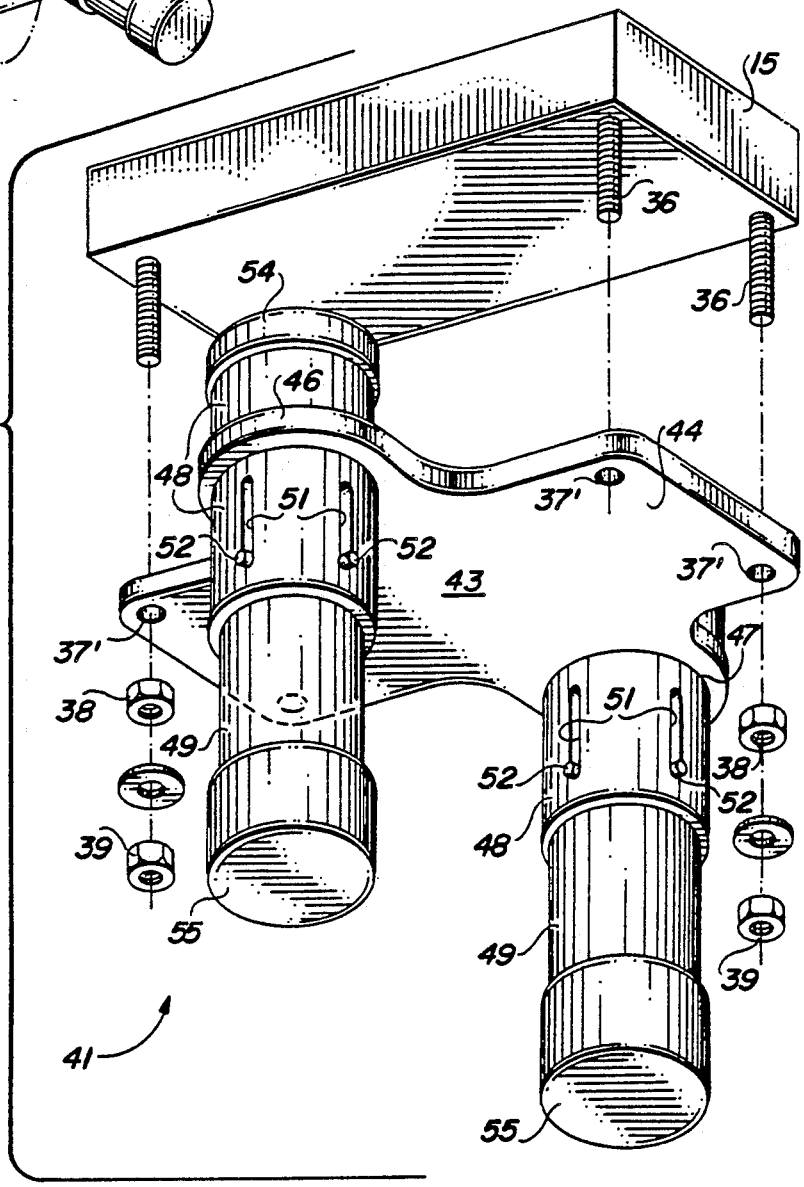
FIG. 4 is an enlarged view of one of the springboard assemblies of FIG. 3, shown in position to substitute for the wheeled truck of FIG. 2.

As shown in FIG. 4, the rear assembly 41 includes a generally planar mounting plate 43 which has a rectangular middle portion 44 with corner bores 37' that occupy the same relative positions as the bores 37 of the riser pad 29 of the truck 13 (see FIG. 2). The plate 43 has an upper surface like that of the pad 29, configured to match the undersurface of the block 15, so that the posts 36 can be brought through the bores 37' and the plate 43 secured to block 15 after removal of the truck 13, in the same manner that truck 13 attaches to the block 15. The plate 43 can be locked at each corner of the mount 15 using the same double nuts 38, 39. The front springboard assembly 40 is similar to rear assembly 41, and replacement of the front truck 14 by attachment of the front springboard assembly 40 to the front mounting block 14 (see FIG. 3) is accomplished in similar fashion.

Figure 5:
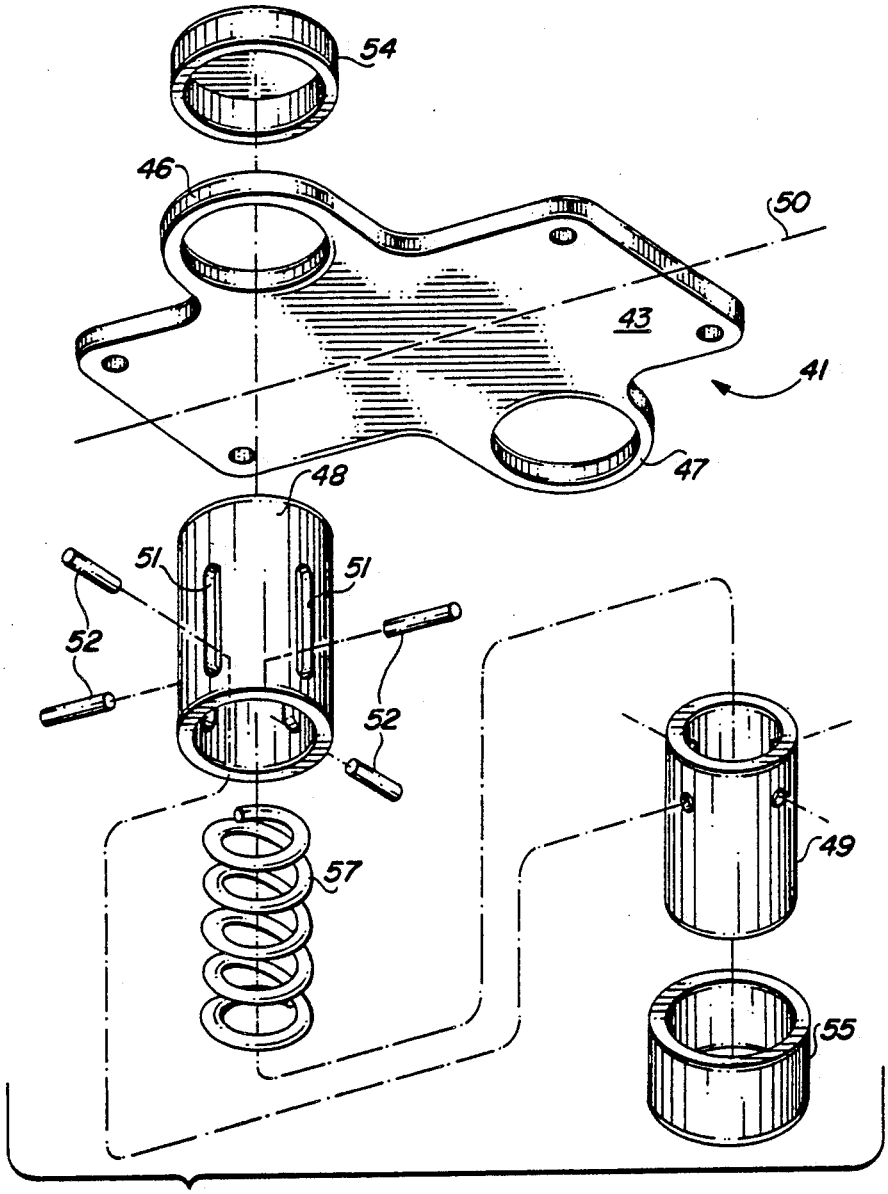
FIG. 5 is an enlarged, exploded view showing the components of one side of the assembly of FIG. 4.

An exemplary construction of the springboard assemblies 41, 42 is shown by the exploded view of the rear assembly 41 in FIG. 5. For clarity of presentation, right-hand components of the assembly 41 have been omitted from the view of FIG. 5. It should be appreciated, however, that the structure will generally be symmetrical about the indicated longitudinal center line 50.

The plate 43 extends generally horizontally, as shown, and has oppositely outwardly directed, left and right open ring portions 46, 47. A hollow tubular sleeve 48 is coaxially received into each ring 46, 47, with the ring extending like a collar peripherally about the circumference of the outside cylindrical surface of the sleeve 48. A second hollow tubular member, in the form of an open-topped cylindrical cup 49 of outside diameter slightly less than the inside diameter of the sleeve 48, is telescopingly coaxially received within the hollow interior of sleeve 48. Sleeve 48 is provided with one or more vertical grooves or channels 51 through which pins 52, secured at their inner ends to the outer surface of cup 49, are extended. Sleeve 48 is closed at its upper end by a cap 54, and a protective cap or tip 55 is provided externally on the bottom of the cup 49. The spline connection formed by the pins 52 acting within the grooves 51 defines the limits of axial travel of the cup 49 relative to the sleeve 48. The cup 49 can travel between a distal position in which the pins 52 are located at the lowermost extremes of the grooves 51, and a proximal position in which the pins 52 are located at the uppermost extremes of the grooves 51.

A coil spring 57 is received with its lower end within the interior of the cup 49 and its upper end restrained either by the inside lid of the cap 54 or by some other suitable stop means (not shown) established within the interior of sleeve 48. The spring 57 serves to bias the cup 49 into its distal or downmost position relative to the sleeve 48. Other appropriate biasing means can also be utilized. It is preferable, for the embodiment of assembly 41 shown in FIGS. 3–5, that the sleeve 48 be positioned within the ring 46 so that the top of the cap 54 will lie flush with the undersurface of the deck 11 (see FIG. 3) when the assembly 41 is attached to the block 15. This has the advantage that, when the full weight of the user is applied downwardly on the upper surface of the deck 11 during use, as further described below, the corresponding upward force exerted on the sleeve 48 will be passed to the deck 11, rather than being imparted to the ring 46.

Figure 6:
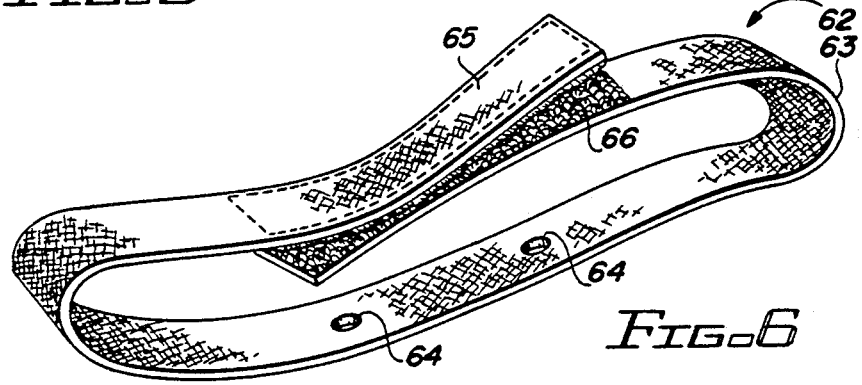
FIG. 6 is a perspective view showing one of the footstrap elements of FIG. 3.

To releasably secure the feet of the user to the upper surface of the board 10 for lifting, when the board 10 is converted to a springboard device in accordance with the invention, front and rear footstraps 61, 62 (shown by dot-dot-dashed lines in FIG. 3) may be attached to extend laterally across the deck as indicated. As shown in FIG. 6 for the rear strap 62, each strap comprises a length of belt material 63 having means, such as apertures 64, for attaching an intermediate portion of the belt 63 to the block 15. The apertures 64 are spaced to fit over a laterally spaced pair of posts 36 of the block 15 before attachment of the mounting plate 43. The opposite free ends of the belt 63 are provided with length-adjustable, readily releasable fastening means such as facing complementary strips 65, 66 of hook and eye VELCRO TM fastening material. The front footstrap 61 is similarly configured.

In operation, the traditional trucks 12, 13 are removed from their respective front and rear positions on mounting blocks 14, 15 of the conventional skateboard 10 (FIGS. 1 and 2), and are replaced by front and rear springboard assemblies 40, 41 (FIGS. 3–5) which attach in the same positions on the same blocks. The assemblies 40, 41 each have left and right telescoping members 48, 49 biased apart by means of coil springs 57 (see FIG. 5). A user standing on the upper surface of the deck 11 of the converted board 10 with one foot inserted into a front strap 61 (FIG. 3) and the other into a rear strap 62 (FIGS. 3 and 6), raises the board 10 up and moves it forward along a path by jumping into the air. When the board 10 lands, the downward force of the landing user standing on the deck 11 is applied through the cap 54 to drive the sleeve 48 telescopingly, downward to further envelop the cup 49. The spring 57 compresses to store energy which is then imparted as a restoring force to assist the next upward jump of the user. In this manner, the user undertakes a series of leaps and bounds with assistance for each jump provided by recovering some of the energy stored by loading the springs at each landing.

It will be appreciated that, while the embodiment shown in FIGS. 3–5 provides front and rear springboard assemblies 40, 41 adapted for converting a conventional skateboard 10 into a springboard device, a springboard device can be provided directly which does not depend on the adaptation of assemblies such as 40, 41 to be mounted in place existing wheeled truck mounting blocks 14, 15.

The spring constants of the springs 57 are chosen in consideration of the weight of the deck and of the weight of the anticipated average user of the device, so that the telescoping members will be in their distal positional relationship with user weight applied but will be moved towards their proximal positional relationship when the lifted deck 11 is landed, without bottoming out after several increasingly more energetic bounds.

Those skilled in the art to which the invention relates will appreciate that the preferred embodiments of the invention described in detail above are just examples of how the invention can be implemented, and that various substitutions and modifications may be made to the same without departing from the spirit and scope of the invention as defined by the claims below.

What is claimed is:

1. An attachment for converting a conventional skateboard into a springboard device; said skateboard comprising:

a generally planar deck having an upper surface for supporting both feet of a user simultaneously thereon, and an undersurface; first and second mounting blocks located at front and rear positions on said undersurface; first and second wheeled trucks, including riser pads having upper surfaces shaped to be brought into superposed aligned abutment beneath said blocks; and means, including a plurality of posts depending from said blocks, respectively releasably attaching said trucks to said blocks by passing said posts through said pads;

and said attachment comprising:

a springboard assembly including first and second mounting plates, each mounting plate having an upper surface shaped to be brought into superposed aligned abutment beneath a respective one of said blocks; and said plates being dimensioned, configured and adapted for being releasably attached to said blocks in place of said trucks by said means attaching said trucks by passing said posts through said plates; and said assembly further comprising a pair of first members respectively connected to each of said plates; a pair of second members associated with each of said plates; means respectively mounting said second members for telescopic movement between distal and proximal positions relative to said first members; and means biasing said second members into said distal positions.

2. An attachment as in claim 1, wherein said blocks, upper surfaces of said pads and upper surfaces of said plates are rectangular; said posts are located at respective corners of said blocks; said plates have bores relatively located to correspond with the locations of said posts; and said assembly is dimensioned, configured and adapted for being attached to said blocks by passing said posts through said bores.

3. An attachment as in claim 1, wherein said first members comprise first tubular members, said second members comprise second tubular members coaxially received within said first tubular members, and said second member mounting means comprises spline means for retaining said second members within said first members.

4. An attachment as in claim 3, wherein said biasing means comprises spring means.

5. An attachment as in claim 3, wherein said first tubular members are sleeves with hollow interiors having inside diameters, and said second tubular members are open-topped cylindrical cups telescopingly coaxially received within said hollow interiors and having outside diameters slightly less than said inside diameters.

6. An attachment as in claim 5, wherein said biasing means comprises coil springs having lower ends received within said cups and upper ends, and means respectively restraining said upper ends at said sleeves.

7. An attachment as in claim 6, wherein said spline means comprises grooves in said sleeves, and pins secured to said cups and respectively extending through said grooves.

8. An attachment as in claim 7, wherein said sleeves have upper and lower ends, said cups have bottoms and said open tops of said cups are respectively received within said lower ends of said sleeves, and wherein said assembly is further dimensioned, configured and adapted for being attached at said blocks with said upper ends of said sleeves in operational abutment with said undersurface of said deck.

9. An attachment as in claim 8, wherein said assembly further comprises caps applied over said upper ends of said sleeves, and said abutment of said upper ends with said undersurface occurs at said caps.

10. An attachment as in claim 9, wherein said assembly further comprises protective tips provided externally on said bottoms of said cups.

11. An attachment as in claim 10, wherein said plates comprise horizontal plates having central portions, and first and second open ring portions respectively extending laterally outwardly on opposite sides of said central portions, said plates being dimensioned, configured and adapted for being attached to said blocks at said central portions; and said sleeves being respectively coaxially received within said ring portions.

12. In combination, a conventional skateboard and an attachment converting said skateboard into a springboard device; said skateboard comprising:

a generally planar deck having an upper surface for supporting both feet of a user simultaneously thereon, and an undersurface; first and second mounting blocks located at front and rear positions on said undersurface; first and second wheeled trucks, including riser pads having upper surfaces shaped to be brought into superposed aligned abutment beneath said blocks; and means for respectively releasably attaching said trucks to said blocks;

and said attachment comprising:

a springboard assembly including first and second mounting plates, each mounting plate having an upper surface shaped to be brought into superposed aligned abutment beneath a respective one of said blocks; and said plates being releasably attached to said in place of said trucks by said means for attaching said trucks; and said assembly further comprising a pair of first members respectively connected to each of said plates; a pair of second members associated with each of said plates; means respectively mounting said second members for telescopic movement between distal and proximal positions relative to said first members; and means biasing said second members into said distal positions.

13. A combination as in claim 12, wherein said means for attaching said trucks to said blocks includes a plurality of posts depending from said blocks; and said assembly is attached in place of said trucks by passing said posts through said plates.

14. A combination as in claim 13, wherein said blocks, upper surfaces of said pads and upper surfaces of said plates are rectangular; said posts are located at respective corners of said blocks; said plates have bores relatively located to correspond with the locations of said posts; and said assembly is attached to said blocks by passing said posts through said bores.

* * * * *